US011040270B1

(12) United States Patent
Griffin, Sr.

(10) Patent No.: US 11,040,270 B1
(45) Date of Patent: Jun. 22, 2021

(54) BILLIARD CUE STORAGE ASSEMBLY

(71) Applicant: Dennis Griffin, Sr., Olin, IA (US)

(72) Inventor: Dennis Griffin, Sr., Olin, IA (US)

( * ) Notice: Subject to any disclaimer, the term of this patent is extended or adjusted under 35 U.S.C. 154(b) by 0 days.

(21) Appl. No.: 16/862,079

(22) Filed: Apr. 29, 2020

(51) Int. Cl.
*A63D 15/00* (2006.01)
*A63D 15/16* (2006.01)
*A63D 15/10* (2006.01)

(52) U.S. Cl.
CPC ..... *A63D 15/10* (2013.01); *A63D 15/16* (2013.01)

(58) Field of Classification Search
CPC ..... A63D 15/10; A63D 15/16; A63D 15/00
USPC ..... 473/36–39, 42, 1, 420; 211/68, 70, 78, 211/14; D6/552
See application file for complete search history.

(56) References Cited

U.S. PATENT DOCUMENTS 173,816 A * 2/1876 Rising ..... A63D 15/10 211/68
815,228 A * 3/1906 Stone ..... A63D 15/04 473/10
1,478,043 A 12/1923 Matteson
1,700,274 A 1/1929 Smye
D154,105 S * 6/1949 Deskey ..... D6/552
3,200,918 A 10/1965 Farrell
3,381,824 A * 5/1968 Blumenschein ..... A63D 15/10 211/68
D234,381 S 2/1975 Berger
4,029,313 A * 6/1977 Angulo ..... A63D 15/00 473/1
4,688,685 A * 8/1987 Brace ..... A63C 11/028 211/60.1
4,753,446 A 6/1988 Mills
5,338,261 A 8/1994 Stegman
D475,877 S 6/2003 McCormick
6,932,222 B2 * 8/2005 McCormick ..... A63D 15/005 211/14
D550,492 S 9/2007 Fagundes-Daher
D555,960 S * 11/2007 Pena ..... D6/552
8,177,650 B1 * 5/2012 Tasi ..... A63D 15/00 473/1
2007/0039911 A1 2/2007 Sator
2008/0083680 A1 * 4/2008 Silva ..... A63D 15/10 211/68
2010/0170862 A1 * 7/2010 Poisson ..... A63D 15/10 211/68

* cited by examiner

*Primary Examiner* — Mitra Aryanpour

(57) ABSTRACT

A billiard cue storage assembly for storing a chalking a plurality of billiard sticks includes a stand that has an upper disk spaced from a lower disk. Each of the upper disk and the lower disk has a plurality of holes therein for insertably receiving a billiard cue. Additionally, each of the holes in the lower disk insertably receives a cube of billiard chalk. A rotation disk is rotatably coupled to the lower disk and the rotation disk has a slot therein. The slot is alignable with a respective one of the holes in the lower disk to facilitate the cube of billiard chalk to be urged downwardly out of the respective hole in the lower disk. A plurality of feet is each coupled to the lower disk to support the lower disk above a support surface.

8 Claims, 5 Drawing Sheets

BILLIARD CUE STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to storage devices and more particularly pertains to a new storage device for storing and chalking a plurality of billiard sticks.

(2) Description of Related Art Including Information Disclosed Under 37 CFR 1.97 and 1.98

The prior art relates to storage devices including a billiard cue rack that includes a pair of plates, each having holes therein for vertically storing billiard cues. The prior art discloses a billiard cue storage cart that includes a plurality of vertically oriented tubes for storing billiard cues. The prior art discloses a wall mounted billiard cue rack that includes a plurality of vertically oriented tubes for storing billiard cues. Additionally, the prior art discloses a golf club carrier that includes a pair of spaced plates, each of said slots therein for vertically storing golf clubs. The prior art also discloses a box that has a plurality of tube being integrated therein for storing billiard cues.

BRIEF SUMMARY OF THE INVENTION

An embodiment of the disclosure meets the needs presented above by generally comprising a stand that has an upper disk spaced from a lower disk. Each of the upper disk and the lower disk has a plurality of holes therein for insertably receiving a billiard cue. Additionally, each of the holes in the lower disk insertably receives a cube of billiard chalk. A rotation disk is rotatably coupled to the lower disk and the rotation disk has a slot therein. The slot is alignable with a respective one of the holes in the lower disk to facilitate the cube of billiard chalk to be urged downwardly out of the respective hole in the lower disk. A plurality of feet is each coupled to the lower disk to support the lower disk above a support surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
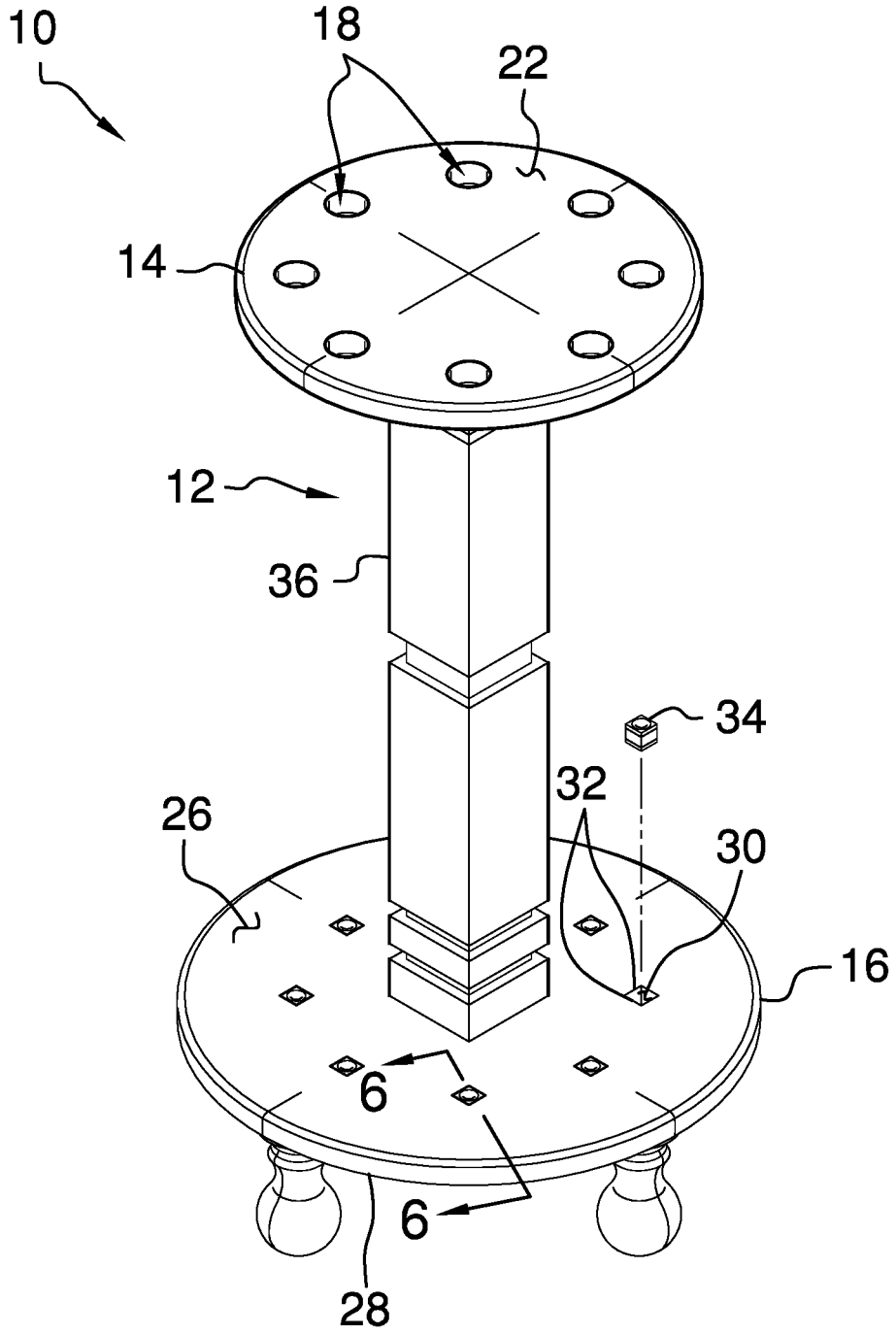
FIG. 1 is a perspective view of a billiard cue storage assembly according to an embodiment of the disclosure.
Figure 2:
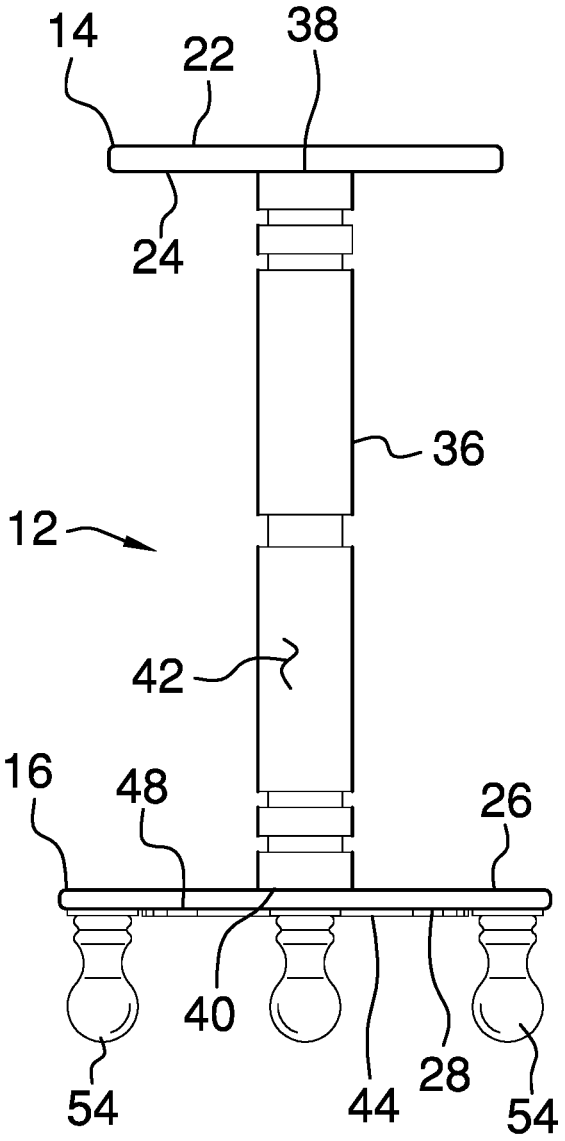
FIG. 2 is a front view of an embodiment of the disclosure.
Figure 3:
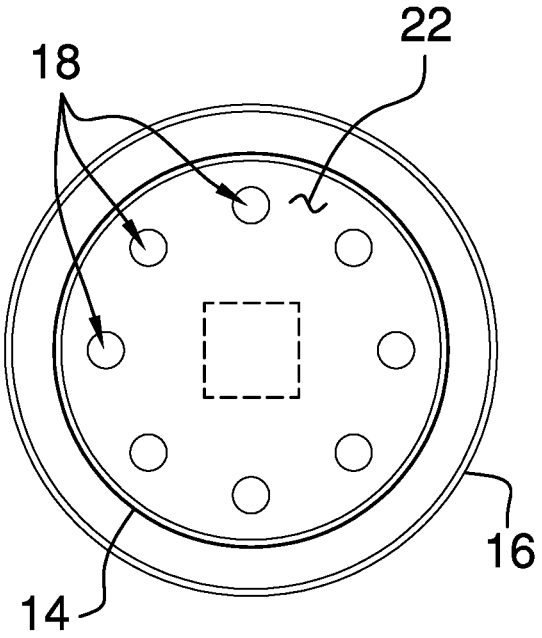
FIG. 3 is a top phantom view of an embodiment of the disclosure.
Figure 4:
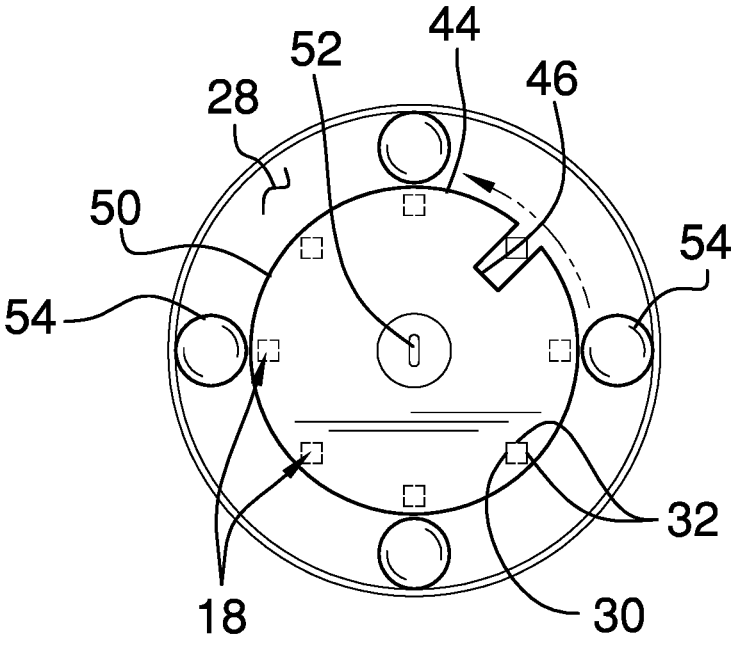
FIG. 4 is a bottom view of an embodiment of the disclosure.
Figure 5:
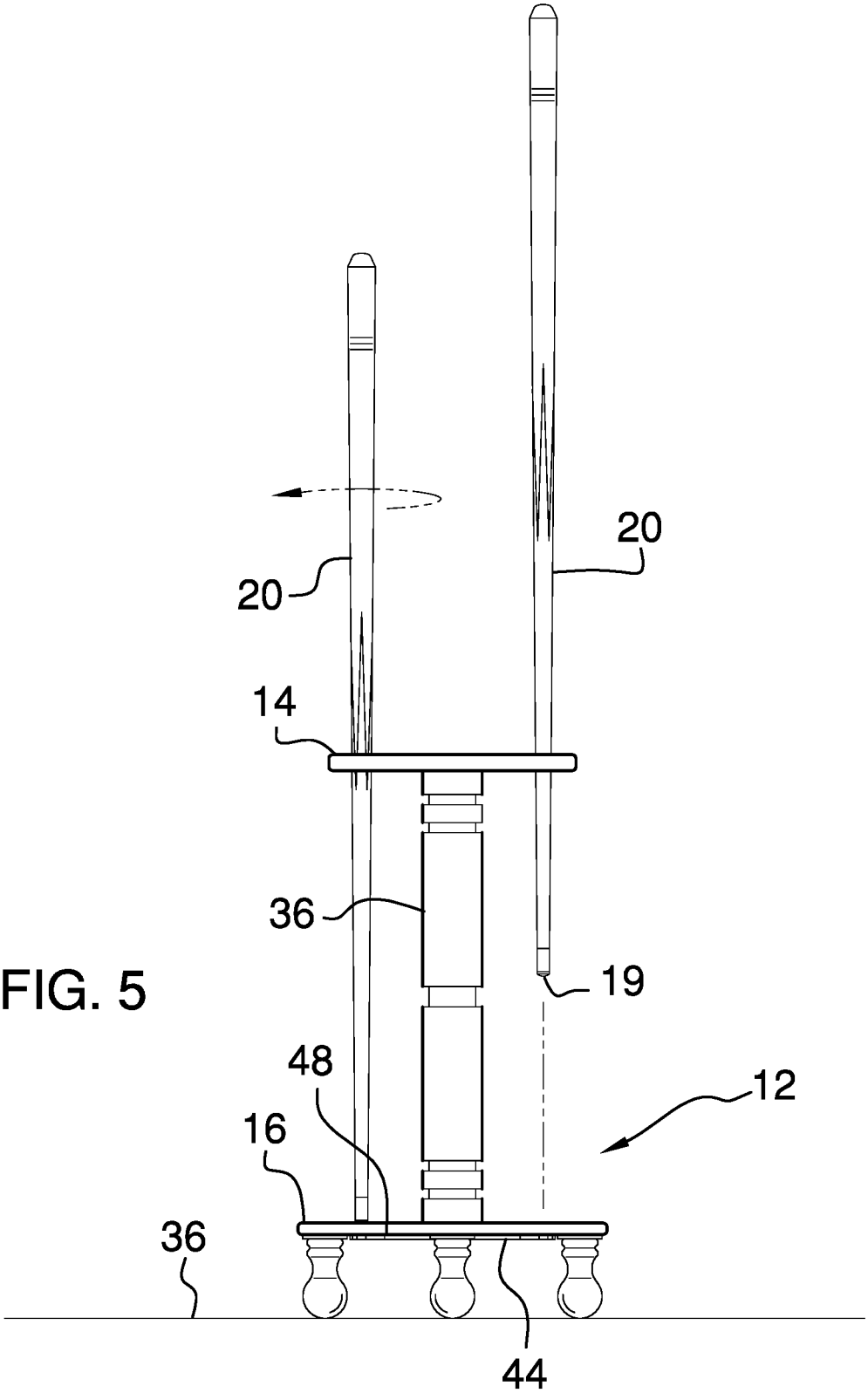
FIG. 5 is a perspective in-use view of an embodiment of the disclosure.
Figure 6:
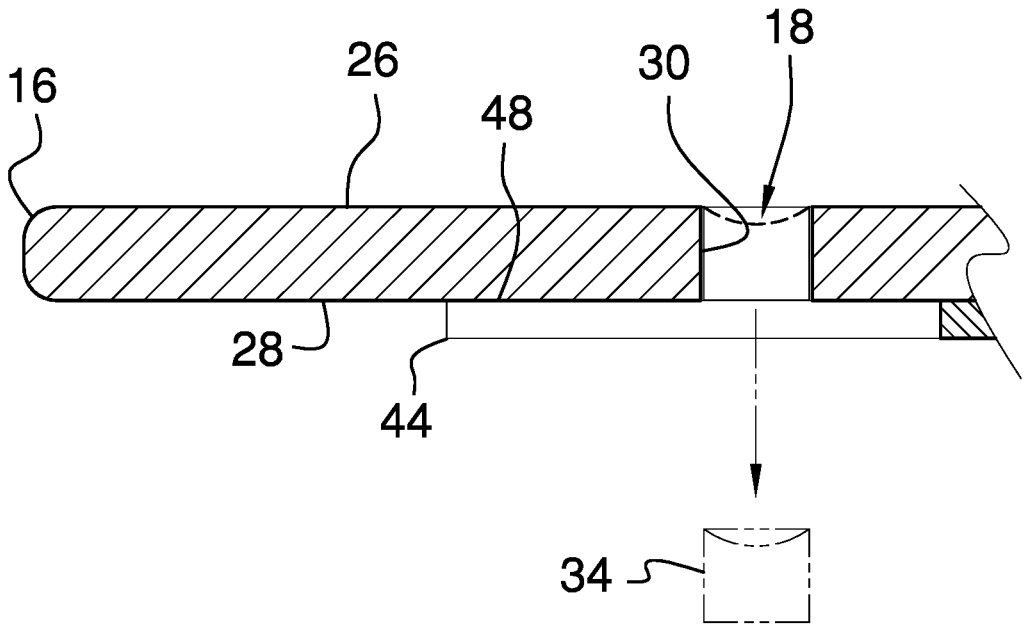
FIG. 6 is a cross sectional view taken along line 6-6 of FIG. 1 of an embodiment of the disclosure.

With reference now to the drawings, and in particular to FIGS. 1 through 6 thereof, a new storage device embodying the principles and concepts of an embodiment of the disclosure and generally designated by the reference numeral 10 will be described.

As best illustrated in FIGS. 1 through 6, the billiard cue storage assembly 10 generally comprises a stand 12 that has an upper disk 14 that is spaced from a lower disk 16. Each of the upper disk 14 and the lower disk 16 has a plurality of holes 18 therein for insertably receiving a billiard cue 20. The upper disk 14 has a top surface 22 and a bottom surface 24, and the lower disk 16 has an upper surface 26 and a lower surface 28. Each of the holes 18 in the upper disk 14 extends through the top surface 22 and the bottom surface 24 for having a billiard cue 20 extended therethrough. The holes 18 in the upper disk 14 are spaced apart from each other and are distributed around a full circumference of the upper disk 14.

Each of the holes 18 in the lower disk 16 extends through the upper surface 26 and the lower surface 28. Each of the holes 18 in the lower disk 16 is aligned with a respective one of the holes 18 in the upper disk 14 to receive a tip 19 of a billiard cue 20 when the billiard cue 20 is passes through the respective hole 18 in the upper disk 14. Moreover, each of the holes 18 in the lower disk 16 has a bounding surface 30 and the bounding surface 30 has a plurality of intersecting sides 32 such that each of the holes 18 in the lower surface 28 has a rectangular shape. In this way each of the holes 18 in the lower surface 28 can have a cube of billiard chalk 34 positioned therein thereby facilitating the tip 19 of the billiard cue 20 to be chalked.

The stand 12 includes a post 36 that is coupled between the upper disk 14 and the lower disk 16, and the post 36 has a top end 38, a bottom end 40 and an outer surface 42 extending therebetween. The top end 38 is coupled to the bottom surface 24 of the upper disk 14 and the bottom end 40 is coupled to the upper surface 26 of the lower disk 16. Additionally, the stand 12 is centrally positioned on the upper disk 14 and the lower disk 16. The outer surface 42 has a plurality of ornamental features carved therein for enhancing the ornamental appeal of the post 36.

A rotation disk 44 is rotatably coupled to the lower disk 16 and the rotation disk 44 has a slot 46 therein. The slot 46 is alignable with a respective one of the holes 18 in the lower disk 16 to facilitate the cube of billiard chalk 34 to be urged downwardly out of the respective hole 18 in the lower disk 16. The rotation disk 44 has a topmost surface 48 and a perimeter surface 50, and the topmost surface 48 rotatably engages the lower surface 28 of the lower disk 16 at a rotation point 52 that is centrally positioned on the rotation disk 44 and the lower disk 16. The slot 46 extends from the perimeter surface 50 toward the rotation point 52 and the rotation disk 44 has a diameter is less than the diameter of the lower disk 16.

A plurality of feet 54 is provided and each of the feet 54 is coupled to the lower disk 16 to support the lower disk 16 above a support surface 56. Each of the feet 54 is positioned on the lower surface 28 of the lower disk 16 and each of the feet 54 is independent from the rotation disk 44. Each of the feet 54 may comprise a ball or other ornamental geometric shape. The post 36 may have a length ranging between approximately 40.0 inches and 48.0 inches. Additionally, each of the upper disk 14 and the lower disk 16 may have a diameter ranging between approximately 14.0 inches and 24.0 inches.

In use, cubes of billiard chalk 34 are placed in each of the holes 18 in the lower disk 16 and a billiard cue 20 is extended downwardly through a respective one of the holes 18 in the upper disk 14. In this way the tip 19 of the billiard cue 20 is placed on the cube of billiard chalk 34 in the respective hole 18 in the lower disk 16. Thus, the billiard cue 20 can be stored in a manner that facilitates the billiard cue 20 to be chalked and ready for use by the next person. The rotation disk 44 is rotated to align the slot 46 with a respective one of the holes 18 in the lower disk 16 for removing and replacing the cube of billiard chalk 34 in the respective hole 18 in the lower disk 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A billiard cue storage assembly having billiard chalk being removably positionable therein for chalking a tip of a billiard cue when the billiard cue is being stored, said assembly comprising:

a stand having an upper disk being spaced from a lower disk, each of said upper disk and said lower disk having a plurality of holes therein for insertably receiving a billiard cue, each of said plurality of holes in said lower disk insertably receiving a cube of billiard chalk;

wherein said stand includes a post being coupled between said upper disk and said lower disk;

a rotation disk being rotatably coupled to said lower disk, said rotation disk having a slot therein, said slot being alignable with a respective one of said plurality of holes in said lower disk wherein said slot is configured to facilitate the cube of billiard chalk to be urged downwardly out of said respective hole in said lower disk; and a plurality of feet, each of said feet being coupled to said lower disk wherein said plurality of feet is configured to support said lower disk above a support surface.

2. The assembly according to claim 1, wherein said upper disk has a top surface and a bottom surface, said lower disk having an upper surface and a lower surface, each of said plurality of holes in said upper disk extending through said top surface and said bottom surface wherein each of said plurality of holes in said upper disk is configured to have a billiard cue extended therethrough, said plurality of holes in said upper disk being spaced apart from each other and being distributed around a full circumference of said upper disk.

3. The assembly according to claim 2, wherein each of said plurality of holes in said lower disk extends through said upper surface and said lower surface, each of said plurality of holes in said lower disk being aligned with a respective one of said holes in said upper disk wherein each of said plurality of holes in said lower disk is configured to receive a tip of a billiard cue when the billiard cue is passed through said respective hole in said upper disk.

4. The assembly according to claim 1, wherein each of said holes in said lower disk has a bounding surface, said bounding surface having a plurality of intersecting sides such that each of said plurality of holes in said lower surface has a rectangular shape wherein each of said plurality of holes in said lower surface is configured to have a cube of billiard chalk being positioned therein thereby facilitating the tip of the billiard cue to be chalked.

5. The assembly according to claim 2, wherein said post has a top end, a bottom end and an outer surface extending therebetween, said top end being coupled to said bottom surface of said upper disk, said bottom end being coupled to said upper surface of said lower disk, said stand being centrally positioned on said upper disk and said lower disk, said outer surface having a plurality of ornamental features being carved therein for enhancing the ornamental appeal of said post.

6. The assembly according to claim 2, wherein said rotation disk has a topmost surface and a perimeter surface, said topmost surface rotatably engaging said lower surface of said lower disk at a rotation point, said slot extending from said perimeter surface toward said rotation point, said rotation disk having a diameter being less than the diameter of said lower disk.

7. The assembly according to claim 2, wherein each of said plurality of feet is positioned on said lower surface of said lower disk, each of said feet being independent from said rotation disk.

8. A billiard cue storage assembly having billiard chalk being removably positionable therein for chalking a tip of a billiard cue when the billiard cue is being stored, said assembly comprising:

a stand having an upper disk being spaced from a lower disk, each of said upper disk and said lower disk having a plurality of holes therein for insertably receiving a billiard cue, said upper disk having a top surface and a bottom surface, said lower disk having an upper surface and a lower surface, each of said plurality of holes in said upper disk extending through said top surface and said bottom surface wherein each of said plurality of holes in said upper disk is configured to have a billiard cue extended therethrough, said plurality of holes in said upper disk being spaced apart from each other and being distributed around a full circumference of said upper disk, each of said plurality of holes in said lower disk extending through said upper surface and said lower surface, each of said plurality of holes in said lower disk being aligned with a respective one of said plurality of holes in said upper disk wherein each of said plurality of holes in said lower disk is configured to receive a tip of a billiard cue when the billiard cue is passed through said respective hole in said upper disk, each of said plurality of holes in said lower disk having a bounding surface, said bounding surface having a plurality of intersecting sides such that each of said plurality of holes in said lower surface has a rectangular shape wherein each of said plurality of holes in said lower surface is configured to have a cube of billiard chalk being positioned therein thereby facilitating the tip of the billiard cue to be chalked;

wherein said stand includes a post being coupled between said upper disk and said lower disk, said post having a top end, a bottom end and an outer surface extending therebetween, said top end being coupled to said bottom surface of said upper disk, said bottom end being coupled to said upper surface of said lower disk, said stand being centrally positioned on said upper disk and said lower disk, said outer surface having a plurality of ornamental features being carved therein for enhancing the ornamental appeal of said post;

a rotation disk being rotatably coupled to said lower disk, said rotation disk having a slot therein, said slot being alignable with a respective one of said plurality of holes in said lower disk wherein said slot is configured to facilitate the cube of billiard chalk to be urged downwardly out of said respective hole in said lower disk, said rotation disk having a topmost surface and a perimeter surface, said topmost surface rotatably engaging said lower surface of said lower disk at a rotation point, said slot extending from said perimeter surface toward said rotation point, said rotation disk having a diameter being less than the diameter of said lower disk; and a plurality of feet, each of said feet being coupled to said lower disk wherein said plurality of feet is configured to support said lower disk above a support surface, each of said feet being positioned on said lower surface of said lower disk, each of said feet being independent from said rotation disk.

* * * * *